US006382627B1

(12) United States Patent
Lundberg

(10) Patent No.: US 6,382,627 B1
(45) Date of Patent: May 7, 2002

(54) MULTI-LEVEL GAME BOARD APPARATUS

(76) Inventor: James R. Lundberg, 4646 Bonita Rd., Bonita, CA (US) 91902

( * ) Notice: Subject to any disclaimer, the term of this patent is extended or adjusted under 35 U.S.C. 154(b) by 0 days.

(21) Appl. No.: 09/778,008

(22) Filed: Feb. 6, 2001

(51) Int. Cl.[7] ..... A63F 3/00

(52) U.S. Cl. ..... 273/285; 273/280; 273/287; 273/241

(58) Field of Search ..... 273/241, 280, 273/283, 285, 287, 286, 236

(56) References Cited

U.S. PATENT DOCUMENTS

| | | | | |
|---|---|---|---|---|
| 2,313,473 | A | * | 3/1943 | Heacock |
| 3,879,040 | A | | 4/1975 | Smith |
| 3,884,474 | A | | 5/1975 | Harper |
| 4,204,685 | A | | 5/1980 | Jones |
| 4,348,027 | A | | 9/1982 | Escamilla-Kelly |
| 4,861,040 | A | | 8/1989 | Peterson |
| 4,883,278 | A | | 11/1989 | Scott |
| 5,085,440 | A | | 2/1992 | Van Dam |
| 5,193,813 | A | | 3/1993 | Goff |
| D348,488 | S | | 7/1994 | Overman |
| D355,447 | S | | 2/1995 | Crump |
| 5,409,234 | A | | 4/1995 | Bechter |
| D387,390 | S | | 12/1997 | Seiler |
| D420,057 | S | | 2/2000 | Colombo |
| 6,273,422 | B1 | * | 8/2001 | McGahan |

OTHER PUBLICATIONS

The Handyman's Handbook, 1982; Publisher, James Mitchell.

* cited by examiner

*Primary Examiner*—Benjamin H. Layno
*Assistant Examiner*—Vishu K Mendiratta
(74) *Attorney, Agent, or Firm*—Brown, Martin, Haller & McClain LLP

(57) ABSTRACT

A multi-level game board apparatus has a plurality of transparent, planar game boards each having a plurality of marker seats arranged in a pattern for receiving game markers, and a plurality of support shaft assemblies extending at spaced intervals through the peripheral edges of the game boards to secure the game boards together and hold them apart at a predetermined vertical spacing during game play. The apparatus is movable between an upright, deployed position in which each support shaft assembly is in a vertically extended position holding the game boards apart, and a collapsed, storage position in which each support shaft assembly is collapsed downwardly between each adjacent pair of boards to allow the boards to move closer together into a more compact, storage configuration. A locking device releasably secures the boards together in the collapsed, storage position. A biasing device biases each support shaft assembly into the vertically extended position so that the boards are automatically moved into the vertically spaced, deployed position on release of the locking device.

19 Claims, 8 Drawing Sheets

MULTI-LEVEL GAME BOARD APPARATUS

BACKGROUND OF THE INVENTION

The present invention relates generally to game board devices and is particularly concerned with a multi-level game board apparatus of the type used for playing multi-dimensional tic-tac-toe and similar games.

The traditional game of tic-tac-toe is played on a one-dimensional surface having a square grid configuration. In each turn, a player places a mark in a selected one of the squares, attempting to make a line in an x, y or diagonal direction. Play proceeds until a player has made a line or no further possible lines remain.

Various multi-level game board devices have been proposed in the past for playing three dimensional strategy games such as tic-tac-toe or the like, permitting placing of game markers in a straight line or row in any one of three available dimensions, i.e. x, y or z, as well as diagonals in any horizontal or vertical plane. These devices typically comprise a series of three or more transparent boards with apertures arranged in a square grid, and a suitable vertical support assembly for supporting the boards horizontally at a selected vertical spacing. For example, U.S. Pat. No. 5,085,440 of Van Dam describes a multiplanar board game having transparent boards supported at spaced intervals along a central support shaft. Cylindrical spacers or tubes are engaged over the support rod or shaft between the board in order to hold the boards horizontally at the desired vertical spacing. Other multi-level game assemblies of a similar nature are described in U.S. Pat. Nos. 4,883,278 of Scott, 3,884,474 of Harper, and 4,348,027 of Escamilla-Kelly. U.S. Design Patent No. Des. 387,390 of Seiler shows a multi-level game board with vertical support rods permanently secured at the four corners of the boards.

One problem with such multi-dimensional board games is the amount of storage space required when they are not in use. Even though it may be possible to separate the various parts of some of the prior art boards for storage purposes, re-assembly is relatively complex, and one or more of the separate parts may easily become lost, making future re-assembly impossible without replacement. Another problem is that it is sometimes difficult for players to reach between the boards to place a game marker at a desired location

SUMMARY OF THE INVENTION

It is an object of the present invention to provide a new and improved multi-level game board apparatus.

According to the present invention, a multi-level game board apparatus is provided, which comprises a plurality of transparent, planar game boards each having a plurality of marker seats arranged in a pattern for receiving a series of game markers, and a plurality of support shaft assemblies extending through the peripheries of the respective boards at spaced intervals to secure the boards together in a vertically spaced arrangement, the apparatus being movable between an upright, deployed position, and a collapsed, storage condition in which each support shaft assembly is collapsed downwardly to allow the boards to move adjacent one another, a locking device for releasably securing the boards and support shaft assemblies in the collapsed condition, and a biasing device for biasing each support shaft assembly from the collapsed position into a vertically extended position, moving the game boards apart into the vertically spaced, deployed position.

In one exemplary embodiment, each support shaft assembly comprises a series of rigid spacer rods each having a through bore, each spacer rod being positioned between an adjacent pair of game boards, a flexible cord extending through the bores in the spacer rods and aligned mounting openings in the game boards, the flexible cord having opposite ends, and a pair of end stops secured to opposite ends of the flexible cord to secure the cord at a predetermined extension and to secure the game boards and spacer rods together, the extended cord comprising a biasing device for biasing the support shaft assembly and boards into the upright, deployed position in which the spacer rods and cord extend vertically and the boards are oriented horizontally at a vertical spacing equal to the length of a spacer rod.

The boards may each be of square or rectangular shape, having four corners, with mounting openings provided at the respective corners of the boards, and each support shaft assembly extending through the openings at a respective aligned corners of the boards. The boards may alternatively be of other shapes such as circular, polygonal and the like. In order to collapse the apparatus, downward pressure is applied to the uppermost board to urge it towards the lowermost board, while rotating the uppermost board. This causes the underlying spacer rods to collapse downwardly into a generally horizontal orientation while the uppermost board is moved down towards the next board, at an offset position relative to the next underlying board. The process continues with each new level of spacer rods collapsing downwardly in turn, until all the boards are moved into the collapsed condition. This process also acts to stretch or extend the resilient cord. The locking device is then engaged. On release of the locking device, the spring tension in the flexible cord will cause the spacer rods to spring back upwardly into the vertical condition, simultaneously forcing the boards apart and into the upright, deployed condition ready for playing the game.

Any suitable locking device may be used. In one embodiment, each board has a central locking opening, and the locking device comprises a threaded post or bolt for extending through the aligned openings from one outer board through the opposite outer board of the apparatus, and a nut for releasably securing to a projecting end of the bolt.

A base may be provided for supporting the boards in the upright, deployed condition. The base may incorporate a turntable for rotating the deployed boards for convenience when playing the game. Additionally, the nut may comprise a threaded opening in the center of the base for receiving the bolt or locking device.

The multi-level game board apparatus of this invention is collapsible into a compact condition for storage or transportation when not in use, and may be readily deployed into an upright condition for playing a game simply by releasing a locking device, without having to assemble various parts. This also avoids the risk of losing any one of a plurality of separate assembly parts, since all of the parts of the apparatus are linked together, apart from the locking device.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
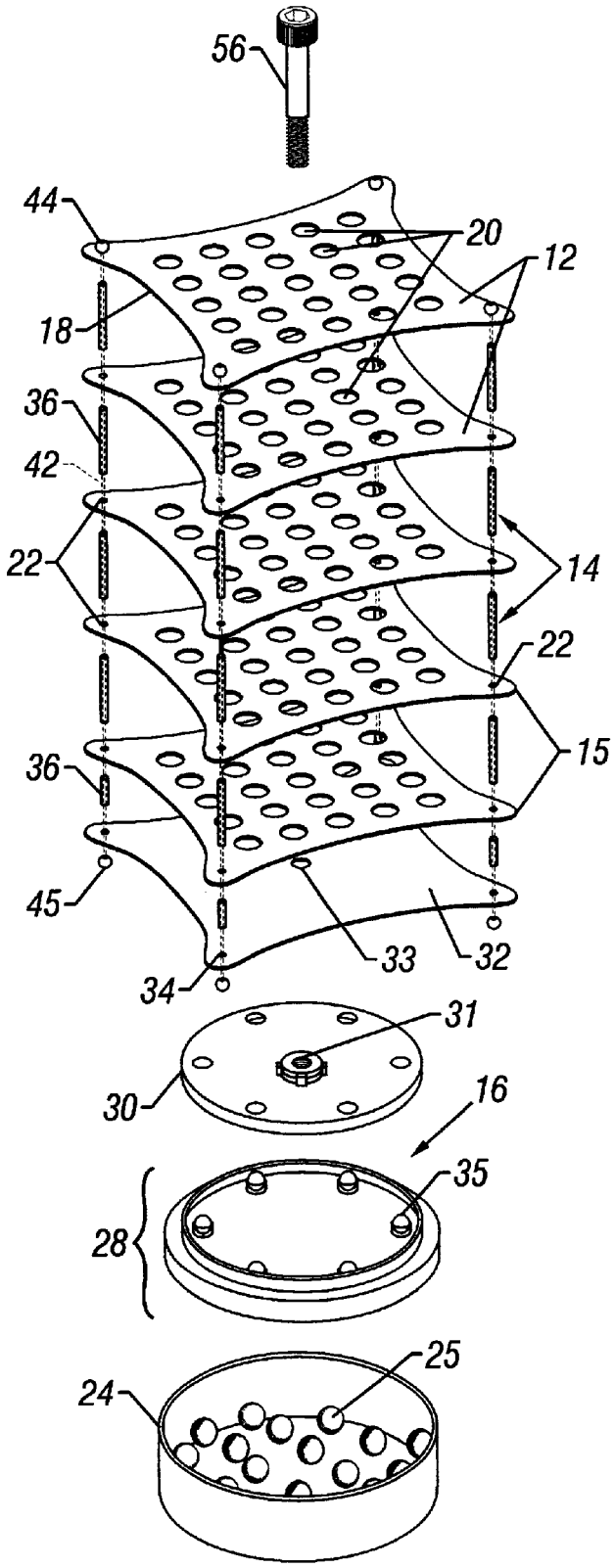
FIG. 1 is an exploded, perspective view of a multi-level game board apparatus according to an exemplary embodiment of the present invention.

FIGS. 1 to 10 of the drawings illustrate a multi-level game board apparatus 10 according to an exemplary embodiment of the present invention. The apparatus 10 basically comprises a series of spaced, transparent boards or plates 12 supported horizontally at a selected vertical spacing by a series of spacer rod assemblies 14 each extending through a respective corner 15 of the apparatus, and a storage base or pedestal 16 for supporting the boards 12 such that the lowermost board is spaced above a support surface for the apparatus.

In the illustrated embodiment, each board 12 is of generally square shape with an arcuate cut-out or indent 18 along each side edge, and has a series of openings or seats 20 arranged in a square array for alignment with corresponding openings 20 in the other boards 12 when the board is in the upright, deployed condition of FIGS. 1 to 4. Each board 12 also has a mounting or support opening 22 at each corner through which the spacer rod assembly extends, as described in more detail below in connection with FIGS. 4 and 5. It will be understood that boards of other shapes may be used, such as rectangular, hexagonal, or other multi-sided shapes, or rounded shapes, and the spacer rod assemblies 14 may be provided at suitable spacings around the periphery of the boards and not necessarily at each corner. Also, the openings 20 may be arranged in different patterns, depending on the game to be played. In the illustrated embodiment, a series of five spaced game boards are provided, with each board having a five-by-five array of openings 20. However, it will be understood that a greater or lesser number of boards may be provided in alternative embodiments, with the openings in each array being adjusted accordingly. The boards are of any suitable transparent, durable material such as transparent plastic material or the like.

The storage base 16 basically comprises a box or container 24 for containing a plurality of spherical game pieces such as balls or marbles 25, which will typically be provided in two different colors, and a multi-part lid 26 for the container. The lid 26 has a first, stationary part 28 with a rim for fitting over the box 24, and an upper part 30 rotatably secured to part 28 to provide a turntable. The upper part 30 includes an enlarged base plate 32 of shape and dimensions matching those of the game boards 12. Plate 32 has no game playing openings 20, but has connector openings 34 at its corners for providing an anchor for the spacer rod assemblies 14, as discussed in more detail below. The upper part 30 is rotatably mounted on the stationary part 28 of the lid via bearings 35. Upper part 30 also has a threaded central opening 31 which is aligned with central openings 20' in each of the game boards 12 and a central opening 33 in base plate 32, which is secured to the upper, rotatable part of the lid by adhesive or the like.

As illustrated in FIGS. 1, 2, 4 and 5, each spacer rod assembly basically comprises a series of four aligned spacer rods 36 each having a through bore 38 and extending between a respective pair of game boards, a lower, shorter spacer rod 40 extending between the lowermost game board and the base plate 32, and a resilient cable or cord 42 extending through the aligned rods 36 and 40 and aligned corner openings 22 and 34 and secured to a respective ball stop member 44,45 at its opposite ends. The cord 42 may be of any suitable material such as elastic or "bungee" type elasticated cord. The arrangement is such that the cord must be extended in order to be secured to the ball stop members, such that each ball stop member is biased inwardly against the respective uppermost game board 12 or the base plate 32, respectively. It can be seen from FIG. 5 that each spacer rod 36 has a diameter greater than that of the respective corner opening 22 or 34, so that each adjacent pair of plates or boards will be held apart at a spacing equal to the length of the spacer rod 36. The lowermost spacer rod 40 is shorter, so that the lowermost game board 12 is spaced above base plate 32 by a short distance sufficient to permit game pieces or balls to be readily placed in the openings in the lower board.

Each ball stop member 44,45 has a through bore 46 of stepped diameter, with a larger diameter upper portion 47 forming a seat for a knot 48 at the upper or lower end of the respective cord. Thus, in the extended or deployed condition of FIGS. 2 and 4, the four spacer rod assemblies act to hold the five game boards or plates 12 and the base plate 32 horizontally at spaced vertical intervals determined by the length of the spacer rods 36 and 40, respectively, with the elastic bungee-type cords 42 biasing the respective end stops 44 and 45 against the uppermost game board 12 and the base plate 32 to prevent separation of the boards and to hold the assembly in its deployed condition during playing of a game. The spacer rods may be of a similar, transparent plastic material to the boards 12 and plate 32, or of any other suitably rigid material which may be transparent or opaque. The ball stops 44, 45 may also be of any suitable material such as wood, metal, plastic or the like.

Figure 2:
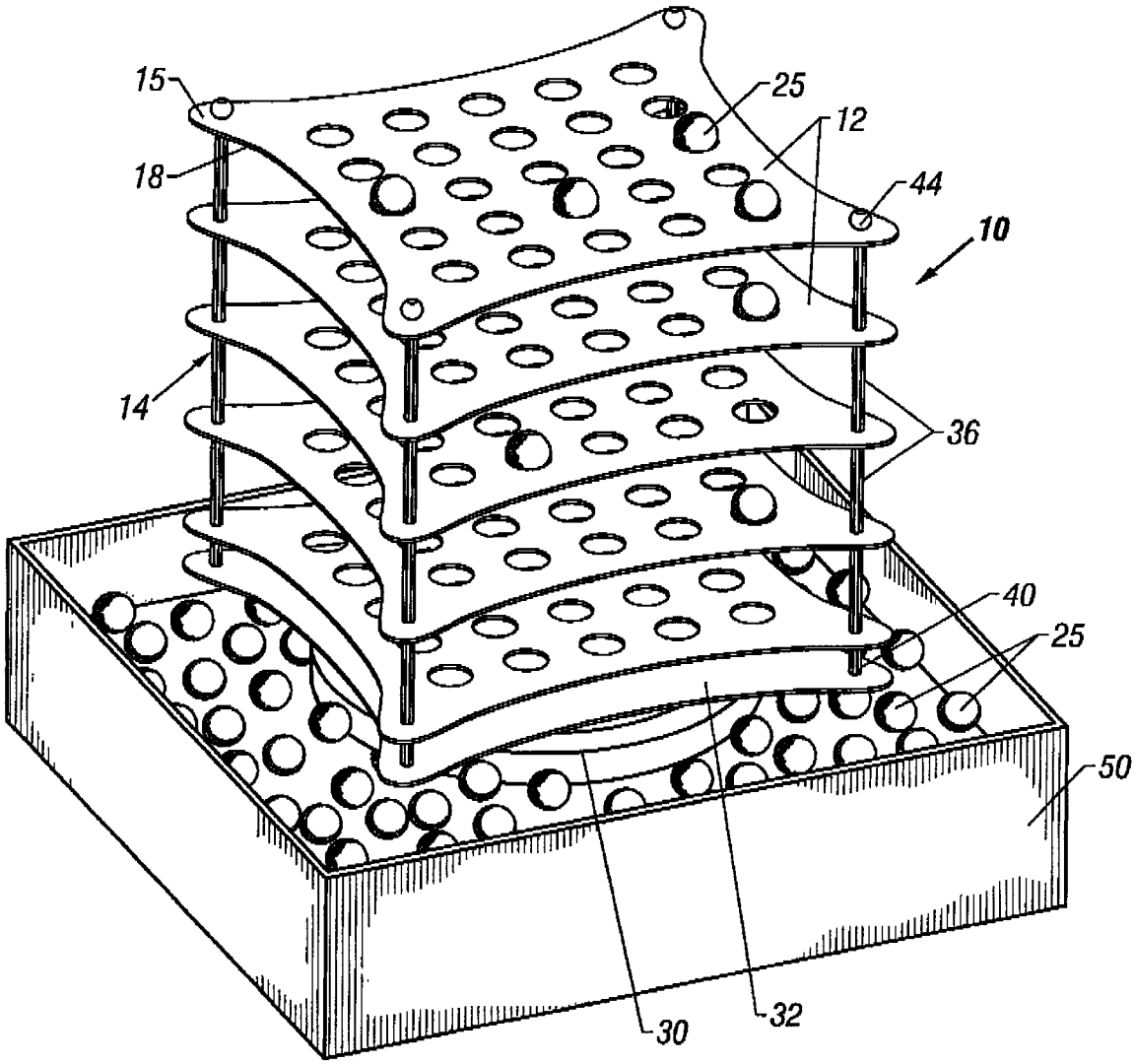
FIG. 2 is a perspective view of the assembled apparatus in an upright, deployed condition, with the game piece storage box of the apparatus mounted in a support tray.
Figure 3:
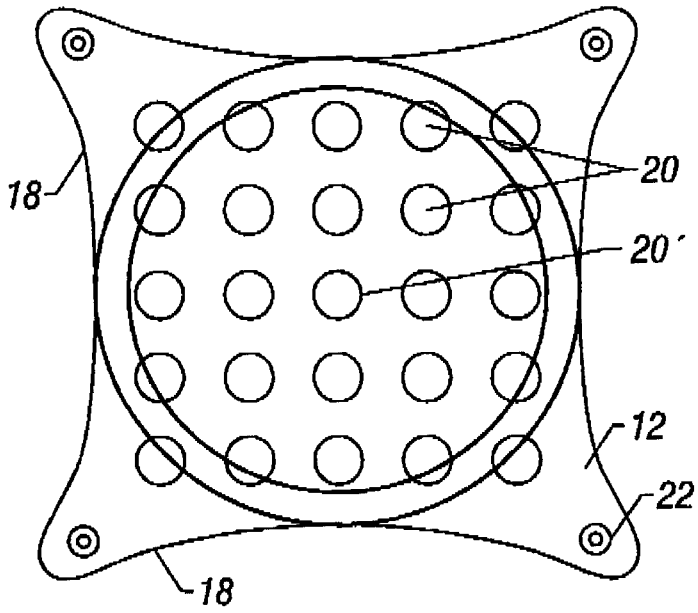
FIG. 3 is a top plan view of the apparatus in the deployed condition.
Figure 4:
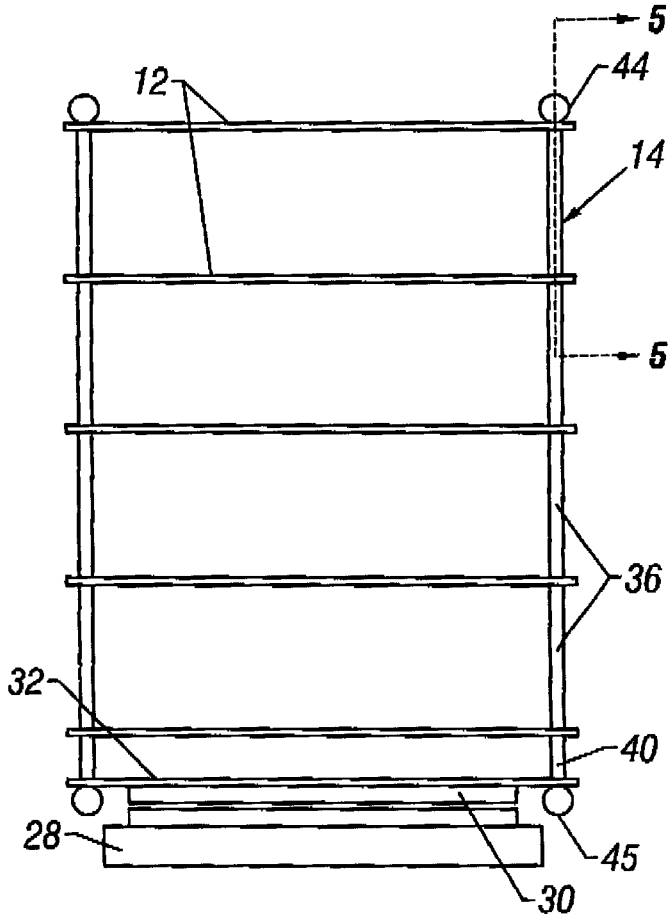
FIG. 4 is a front elevational view of the apparatus with the turntable lid of the storage box removed from the box and rotatably supporting the game boards.
Figure 5:
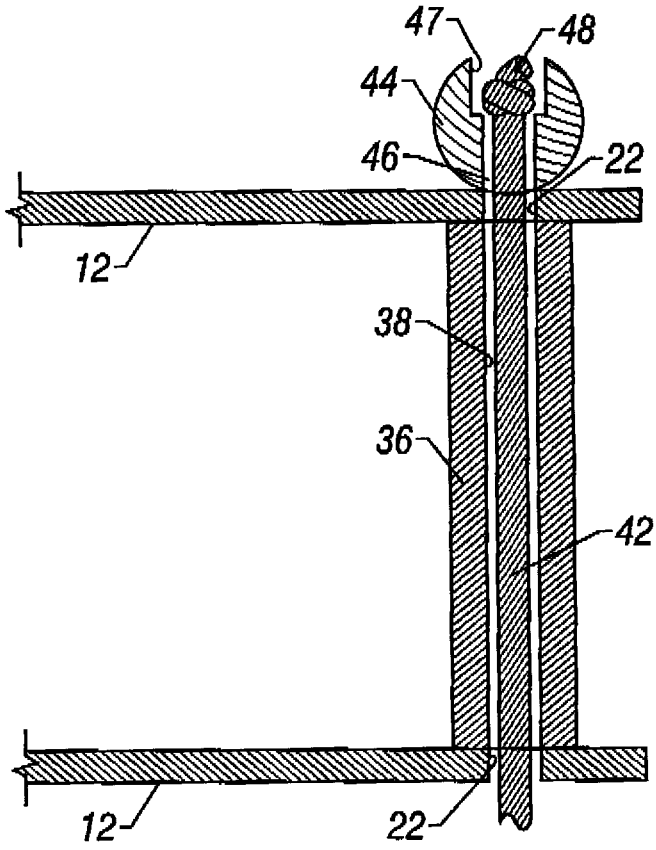
FIG. 5 is a partial vertical cross-section on the lines 5—5 of FIG. 4.
Figure 6:
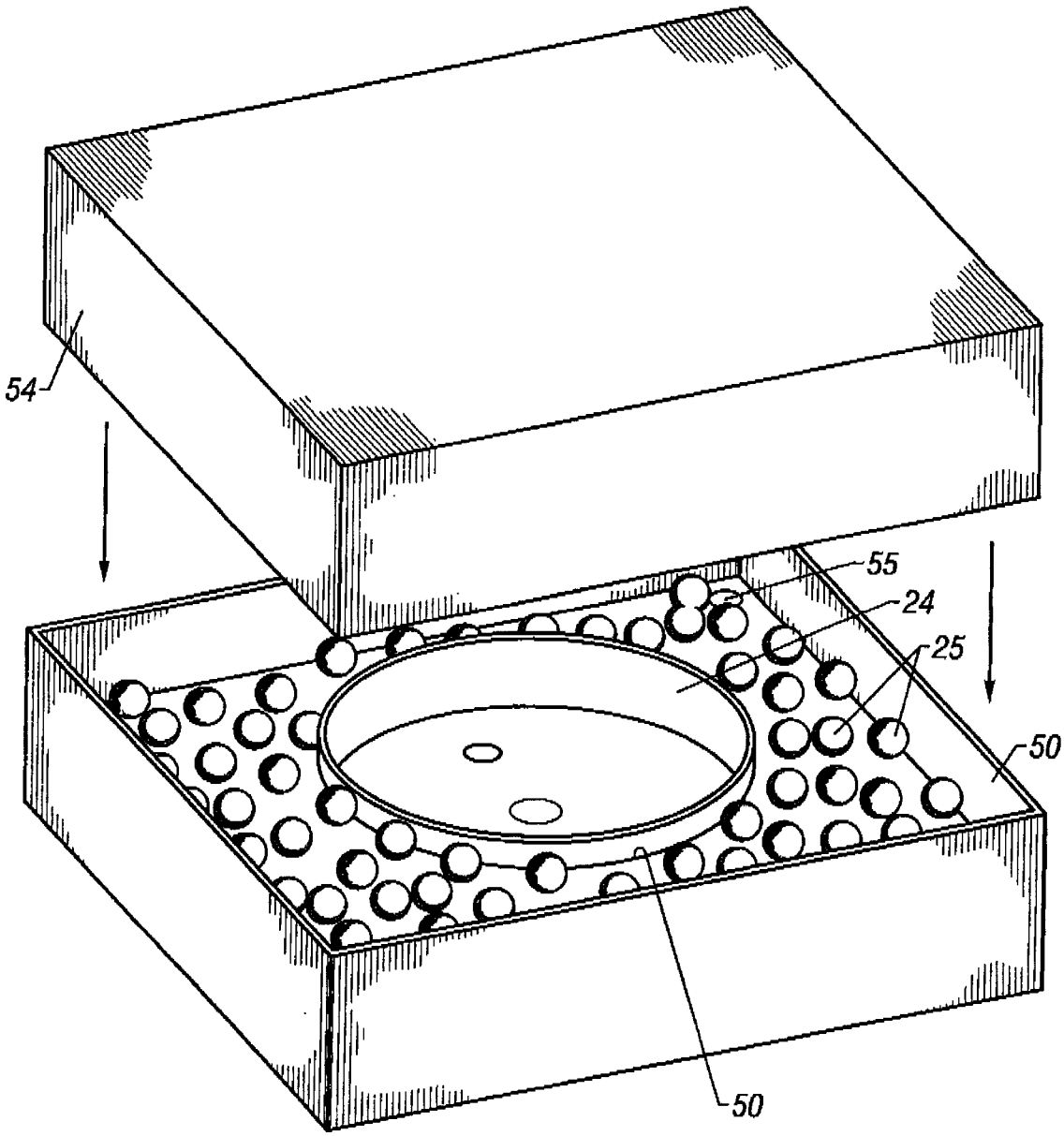
FIG. 6 is an exploded perspective view illustrating an optional storage container for the apparatus, incorporating a tray which may be used to store playing pieces or marbles while playing a game.

Optionally, an outer storage container or box may also be provided for holding the game board apparatus 10 when not in use. This comprises a base tray 50 of rectangular shape having a central, circular opening 52 in which the marble container 24 may be seated, as indicated in FIGS. 2 and 6, and a rectangular lid 54 for fitting over the base tray 50 when the apparatus is collapsed for storage purposes, as described in more detail below in connection with FIGS. 7 to 10. If desired, the lid 26 may be placed over the container 24 while it is seated in the base tray, after first removing the playing pieces or marbles and placing them in the tray 50, as indicated in FIG. 2, and the game may then be played. Alternatively, the marbles 25 may be left in the container 24, and the lid 26 may be placed on a suitable support surface such as a table, as indicated in FIG. 4, in order to play the game. The tray may have openings 55 at its corners for placing a suitable marker to indicate the current player's turn. The outer container may be of cardboard or the like.

Figure 7:
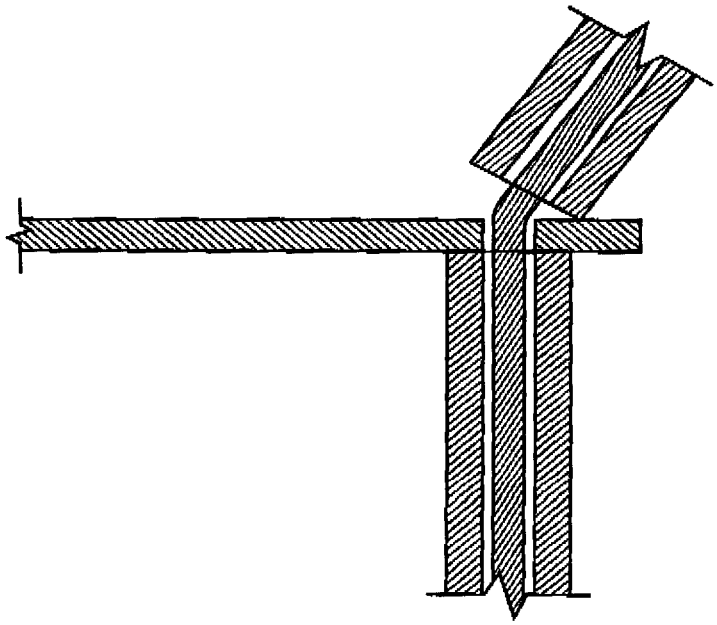
FIG. 7 is a partial cross-section illustrating a spacer rod starting to collapse downwardly as the upper board is urged downwardly and rotated relative to an underlying board.
Figure 8:
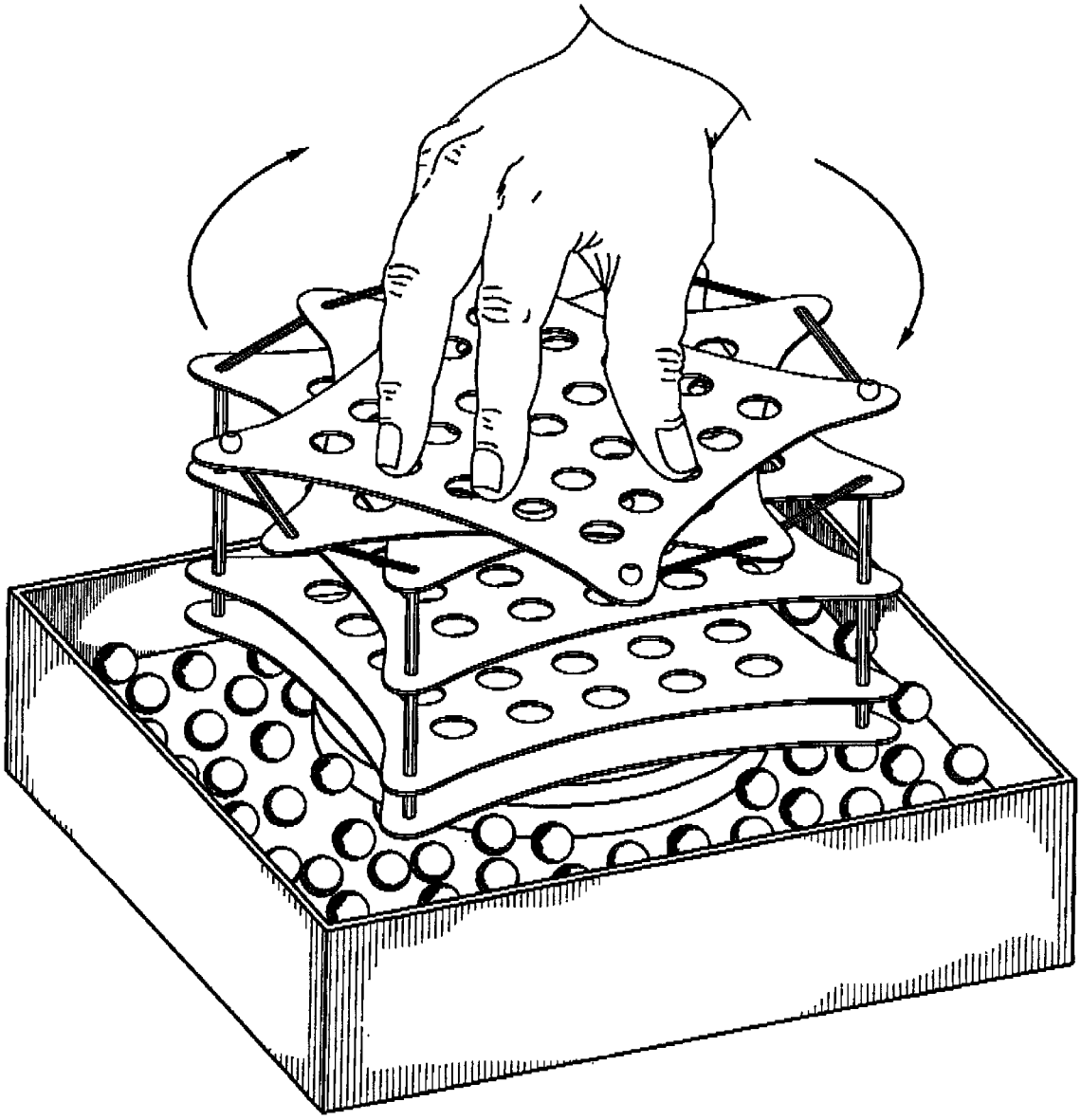
FIG. 8 is a perspective view of the apparatus illustrating a subsequent stage during collapse of the apparatus from its upright condition to its storage condition.
Figure 9:
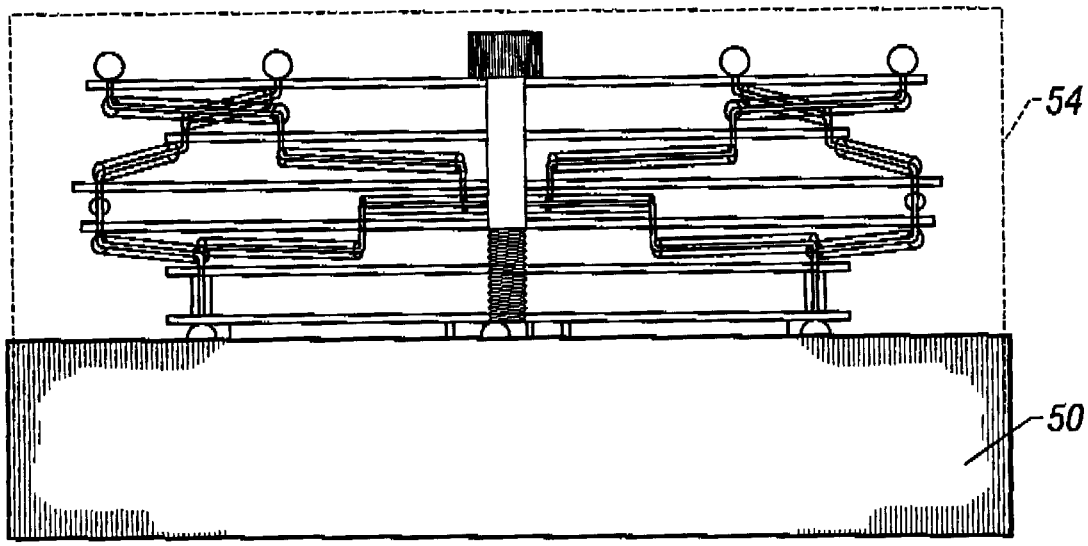
FIG. 9 is a side elevational view of the apparatus in its fully collapsed and locked storage condition, with the game box storage box mounted in the support tray or base and a removable lid for placing over the base tray to hold the entire apparatus.
Figure 10:
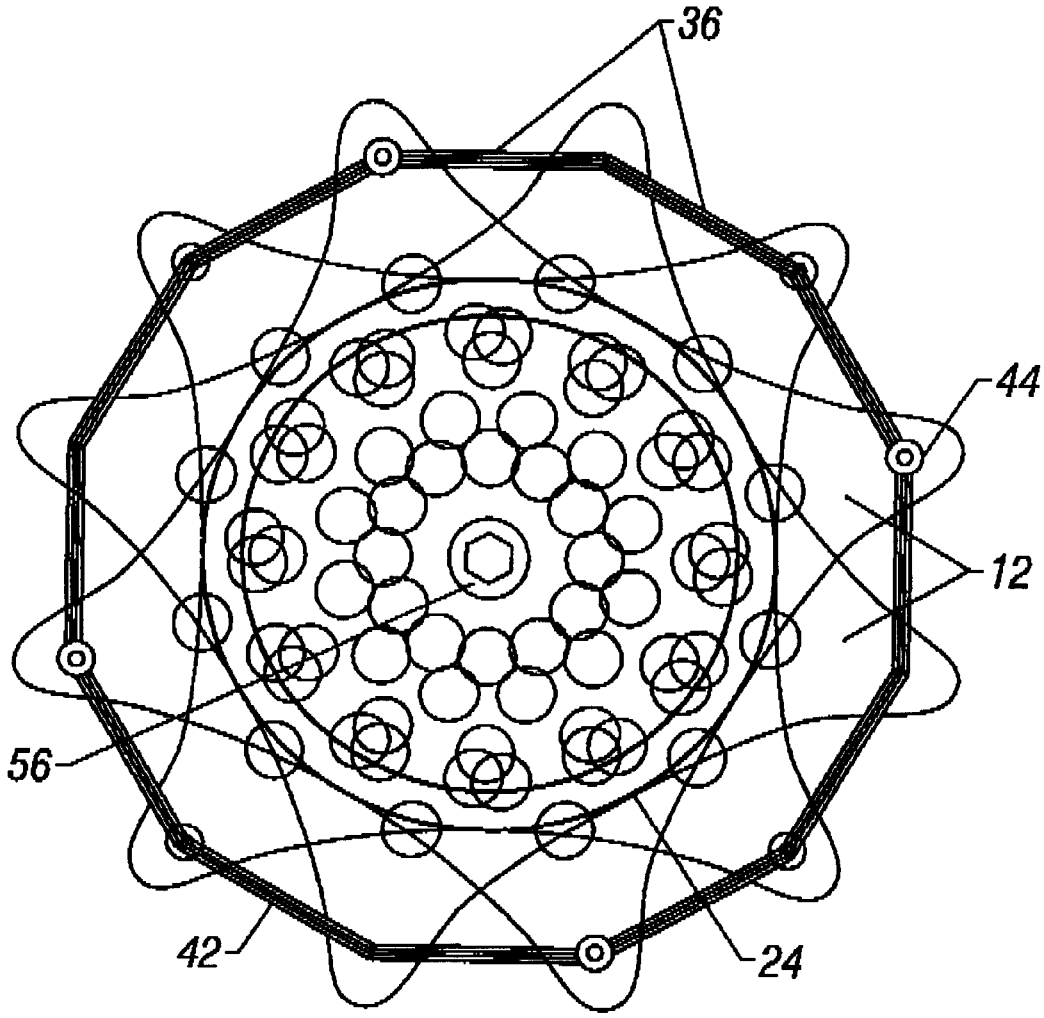
FIG. 10 is a top plan view of the apparatus in its collapsed condition, excluding the outer tray and lid.

When play is complete, the apparatus can be readily collapsed for storage purposes, after first returning the marbles or game pieces 25 to the container 24. The apparatus is collapsed simply by holding the base and pressing the uppermost game board 12 downwardly towards the base plate and at the same time rotating the board 12 in either a clockwise or anti-clockwise direction, as indicated by the arrows in FIG. 8. This will cause the underlying posts or spacer rods 36 to start to collapse or tilt sideways, as indicated in FIG. 7, until eventually all four rods lie horizontally between the two uppermost boards 12, which are now at a spacing equal to the diameter or width of each spacer rod 36. The uppermost boards 12 will also be skewed at an angle relative to one another, as seen in FIG. 8. At this point, continued rotation of the upper two boards 12 will cause the next set of rods 36 to collapse in the same way, and the process continues until all spacer rods 36 have collapsed downwardly. At the same time, each of the elastic or resilient cords or cables 42 will be extended and moved into a non-straight, stepped path through the respective horizontal and tilted spacer rods and the various, now offset, board openings 22, in order to accommodate the tilting of the posts 42. Once all of the boards 12 have been collapsed, a threaded peg or bolt 56 is inserted through the aligned central openings 20' in each of the game boards 12, the aligned central opening 33 in base plate 32, and into the threaded hole or nut 31 in the upper part 30 of the lid. The bolt 56 is tightened as far as possible, and locks the apparatus in the collapsed storage position illustrated in FIG. 9. The container lid 54 may then be placed over the tray in order to enclose the collapsed apparatus.

The apparatus can be readily returned to its upright, deployed condition ready for playing a game, simply by removing the bolt 56 from the nut 31 and game boards. As soon as the bolt is removed, due to the spring tension in the extended bungee cord 42, the posts or spacer rods 36 will all be biased upwardly into their vertical orientation, simultaneously forcing the game boards 12 apart, and returning the cord 42 to its vertical, less stretched condition. Although the support assembly connecting the boards together in the exemplary embodiment comprises a series of spacer rods interconnected by a resilient or elastic cable such as a bungee-type cord, it may alternatively comprise a series of springs extending between the corners of each adjacent pair of plates. The springs would be of sufficient strength to hold the plates apart during game play, and would be compressed for storage, with the same locking bolt securing the plates and springs together in the compressed condition.

Many different possible games may be played using this apparatus. One possibility is a simple tic-tac-toe game, in which each player takes a turn placing a marble in any of the available game piece openings 20, as indicated in FIG. 2. The center openings 20' may be used in the game or may be left as free spaces. The winner is the first person to arrange five marbles in a straight line, either horizontally or diagonally across any board, vertically through all five boards, or diagonally through all five boards. The turntable base allows players to rotate the apparatus to view the current game status readily from all directions, and also to move the apparatus into the most convenient position for placing the next marble at a selected opening. The arcuate indents or cut outs 18 on the side edges of the board make it easier for the player to access the innermost openings 20 on each level of the apparatus.

The multi-level game board apparatus of this invention is readily movable between an upright deployed position in which the game boards are spaced apart for playing, and a collapsed condition in which the game boards are moved adjacent one another for storage or transportation purposes. Only one part needs to be inserted or removed to lock the apparatus in its storage position, or to allow the apparatus to extend automatically into its deployed condition. Thus, unlike prior art multi-level game board devices, the apparatus of this invention may be readily collapsed for storage, so that it does not take up excessive amounts of space, and does not involve multiple separable parts which would make assembly or disassembly difficult and inconvenient. The turntable base also makes play much easier, permitting a player to rotate the apparatus to more easily determine the best position for the next game piece or marble, and to place the apparatus in the optimum location for reaching the desired opening.

Although an exemplary embodiment of the invention has been described above by way of example only, it will be understood by those skilled in the field that modifications may be made to the disclosed embodiment without departing from the scope of the invention, which is defined by the appended claims.

I claim:

1. A multi-level game board apparatus, comprising:

a plurality of transparent, planar game boards each having a plurality of marker seats arranged in a pattern for selectively receiving a series of game markers, each game board having a peripheral edge;

a plurality of support shaft assemblies extending at spaced intervals through the peripheral edges of the game boards to secure the game boards together, the game boards and support shaft assemblies being movable between an upright, deployed position in which the game boards are horizontal and each support shaft assembly is in a vertically extended position holding the game boards apart at a first vertical spacing, and a collapsed, storage position in which each support shaft assembly is collapsed downwardly between each adjacent pair of boards to allow the boards to move closer together;

a locking device for releasably securing the boards together with the support shaft assemblies collapsed in the collapsed, storage position; and each support shaft assembly including a biasing device for biasing the support shaft assembly into the vertically extended position to move the game boards automatically into the vertically spaced, deployed position when the locking device is released.

2. The apparatus as claimed in claim 1, wherein each game board has a series of spaced connector openings around its periphery for alignment with corresponding connector openings in the other boards in the upright, deployed position, and each support shaft assembly comprises a series of rigid spacer rods each having a through bore, each spacer rod being positioned between an adjacent pair of game boards in alignment with the remaining spacer rods in the vertically extended position, a resilient, extensible cord extending through the bores in the spacer rods and an aligned set of connector openings in the game boards, the game boards including an upper board and a lower board, and the flexible cord having opposite ends secured to the upper and lower boards, the spacer rods being collapsed into a generally horizontal orientation when the boards are moved together into the collapsed, storage condition, whereby the extensible, resilient cord comprises said biasing device, the cord being stretched into an extended, non-straight condition on collapse of the boards and spacer rods, and being biased into a less-extended, straight vertical condition on release of the locking device.

3. The apparatus as claimed in claim 2, wherein each support shaft assembly includes a pair of end stops secured to opposite ends of the flexible cord above the upper board and below the lower board, respectively, to secure the cord at a predetermined extension and to secure the game boards and spacer rods together.

4. The apparatus as claimed in claim 1, wherein the game boards include an upper game board and a lower game board, and at least one additional game board between the upper and lower board, the apparatus further including a base for supporting the game boards on a support surface with the lower game board spaced above the surface.

5. The apparatus as claimed in claim 4, wherein the base includes a turntable for allowing rotation of the game boards while playing a game.

6. The apparatus as claimed in claim 4, wherein the base comprises a storage container for storing a plurality of game pieces and a lid for closing the container, the lower game board being mounted on the lid.

7. The apparatus as claimed in claim 6, wherein the base includes a base plate mounted on the lid, and a spacer for spacing the lower game board above the base plate.

8. The apparatus as claimed in claim 6, wherein the lid includes a lower part and an upper part rotatably mounted on the lower part for allowing rotation of the game boards relative to the upper part.

9. The apparatus as claimed in claim 1, including a base member, the game boards include an upper game board, a lower game board, and at least one intermediate board between the upper and lower boards, each game board having a series of spaced connector openings around its periphery for alignment with corresponding connector openings in the other boards in the upright, deployed position, and each support shaft assembly comprising a series of rigid spacer rods each having a through bore, each spacer rod being positioned between an adjacent pair of game boards in alignment with the remaining spacer rods in the vertically extended position, and a lower spacer rod positioned between the lower game board and the base member, a resilient, extensible cord extending through the bores in the spacer rods and an aligned set of connector openings in the game boards, and the flexible cord having opposite ends secured to the upper board and base member, respectively, each of the spacer rods apart from the lower spacer rods being collapsed into a horizontal orientation when the boards are moved together into the collapsed, storage condition, whereby the extensible, resilient cord is stretched into an extended, non-straight condition on collapse of the boards and spacer rods, and is biased into a less-extended, straight vertical condition on release of the locking device.

10. The apparatus as claimed in claim 9, wherein the game boards and base member have aligned, central openings, and the base member has a threaded nut aligned with said central openings, the locking device comprising a bolt for extending through said aligned central openings and threadably engaging said nut to releasably secure the apparatus in the collapsed, storage position.

11. The apparatus as claimed in claim 1, wherein the boards are each of square shape with four corners which are aligned with corresponding corners of the other boards when the apparatus is in the upright, deployed position, and each support shaft assembly extends through respective aligned corners of the boards.

12. The apparatus as claimed in claim 11, wherein each game board has a connector opening at each corner for alignment with corresponding connector openings in the other boards in the upright, deployed position, and each support shaft assembly comprises a series of rigid spacer rods each having a through bore, each spacer rod being positioned between an adjacent pair of game boards in alignment with the remaining spacer rods in the vertically extended position, a resilient, extensible cord extending through the bores in the spacer rods and the aligned set of connector openings at the respective corner of the game boards, the game boards including an upper board and a lower board, and the flexible cord having opposite ends secured to the upper and lower boards, whereby the peripheral edges of the boards are aligned and the spacer rods are vertical in the upright, deployed position and the boards are rotated relative to one another in the collapsed, storage position such that each peripheral edge extends at an angle to the edge of the next adjacent board and the spacer rods are collapsed into a horizontal orientation, whereby the extensible, resilient cord is stretched into an extended, non-straight condition on collapse of the boards and spacer rods, and is biased into a less-extended, straight vertical condition on release of the locking device.

13. The apparatus as claimed in claim 11, wherein each game board has a series of side edges, each side edge having an arcuate indent extending along at least a major part of its length for allowing access to said marker seats.

14. The apparatus as claimed in claim 1, wherein said marker seats comprise circular openings.

15. The apparatus as claimed in claim 1, wherein there are five spaced game boards and each board has a five-by-five square grid of marker seats.

16. The apparatus as claimed in claim 1, including an outer storage container for housing the collapsed game boards and support shaft assemblies in the storage position.

17. The apparatus as claimed in claim 16, including a base having a lower container for storing game pieces and a lid, the game boards including a lower game board secured to the lid, and the base supporting the lower game board at a spacing above a support surface during play, the outer storage container comprising a lower tray having an opening for seating the lower container of the base, the tray being of larger dimensions than the container and comprising a storage tray for game pieces while playing a game, and a removable lid for seating on the tray to enclose the game boards in the collapsed, storage position.

18. A multi-level game board apparatus, comprising:

a plurality of transparent, planar game boards each having a plurality of marker seats arranged in a square grid pattern for selectively receiving a series of game markers, each game board having a peripheral edge;

a plurality of support shaft assemblies extending at spaced intervals through the peripheral edges of the game boards to secure the game boards together, the game boards and support shaft assemblies being movable between an upright, deployed position in which the game boards are horizontal and vertically spaced and each support shaft assembly is in a vertically extended position holding the game boards apart, and a collapsed, storage position in which each support shaft assembly is collapsed downwardly between each adjacent pair of boards to allow the boards to move closer together;

a locking device for releasably securing the boards together with the support shaft assemblies collapsed in the collapsed, storage position; and each support shaft assembly comprising a set of spacer members, each spacer member extending between an adjacent pair of game boards, and incorporating biasing means for biasing the spacer members between a collapsed condition in which the respective pair of game boards is at a first spacing and a vertically extending condition in which the game boards are spaced apart by the spacer member at a second spacing greater than the first spacing.

19. The apparatus as claimed in claim 18, wherein said biasing means comprises a resilient, extensible cord extending continuously through each set of spacer members and the boards, the cord being secured to the outermost boards at a predetermined first extension when the boards and spacer members are in the upright, deployed condition in which the cord and spacer members extend vertically, whereby the spacer members are collapsed downwardly into a horizontal orientation and the cord is stretched beyond said first extension in said collapsed position.

* * * * *